United States Patent [19]

Eckels

[11] 4,452,142

[45] Jun. 5, 1984

[54] MULTIPLE HEAD RUBBER STAMP

[76] Inventor: Robert E. Eckels, 2101 Youngfield, Golden, Colo. 80401

[21] Appl. No.: 157,282

[22] Filed: Jun. 6, 1980

[51] Int. Cl.[3] ..... B41K 1/04; B41K 1/56

[52] U.S. Cl. ..... 101/368; 101/405; 273/DIG. 27

[58] Field of Search ..... 101/368, 405, 406; 273/DIG. 27

[56] References Cited

U.S. PATENT DOCUMENTS

| | | | |
|---|---|---|---|
| 1,112,450 | 10/1914 | Hess | 101/405 |
| 1,142,502 | 6/1915 | Folger | 101/368 |
| 1,420,376 | 6/1922 | Hellesoe | 101/368 |
| 1,789,833 | 1/1931 | Pannier, Jr. et al. | 101/406 |
| 1,982,790 | 12/1934 | Hurbo | 101/368 |
| 2,449,810 | 9/1948 | Guenther | 101/368 |
| 2,899,895 | 8/1959 | Tannery | 101/405 |
| 3,494,040 | 2/1970 | Goodwin | 101/368 |
| 3,597,099 | 8/1971 | Tollin | 101/368 |
| 4,187,772 | 2/1980 | Hollenbeck | 101/406 |

OTHER PUBLICATIONS

Aids & Appliances, 18th Edition, American Foundation for Blind, Jul. 1972, p. 20.

*Primary Examiner*—William Pieprz
*Attorney, Agent, or Firm*—Jack E. Ebel

[57] ABSTRACT

A stamp frame in the general form of a cross, includes a rubber stamp at the end of each cross arm and includes, adjacent the rubber stamp, a raised indicia for the finger touch indication of the information on the stamp, and the arms of the cross are of different length, further aiding the touch contact for indentification of the rubber stamp on the end of the arm.

6 Claims, 8 Drawing Figures

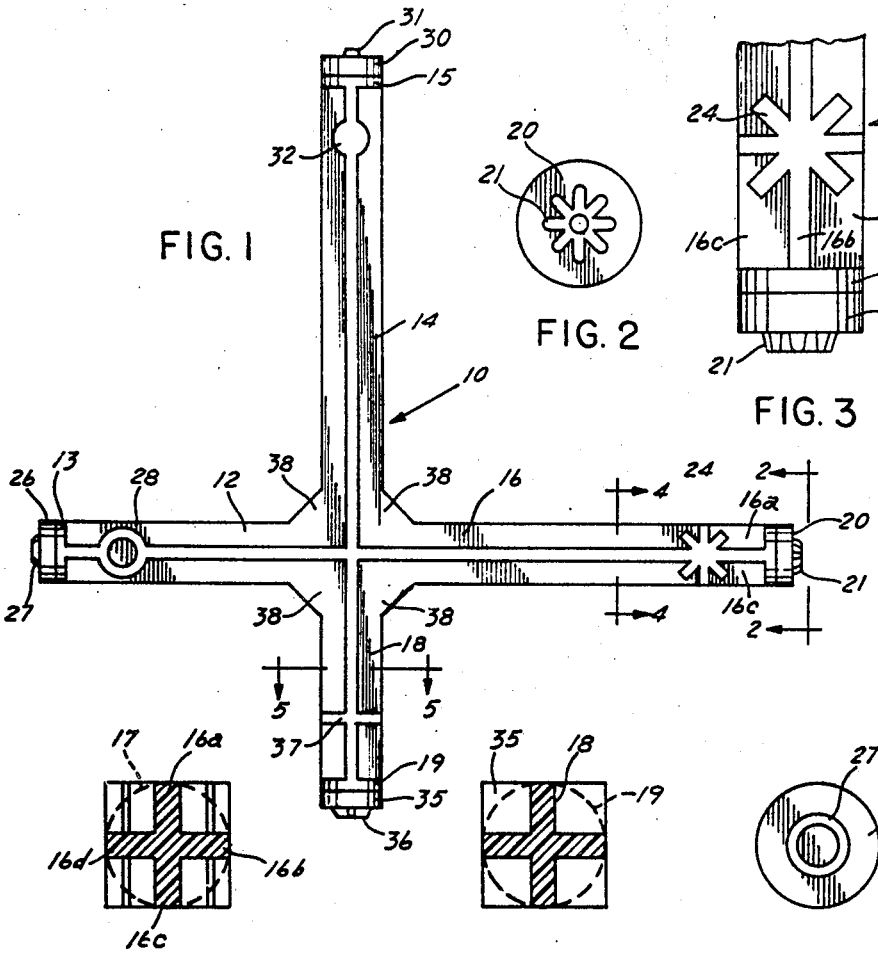
FIG. 1
FIG. 2
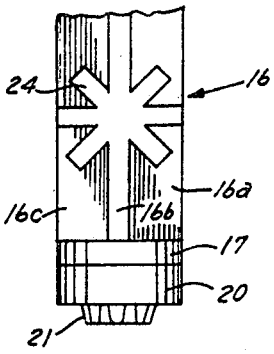
FIG. 3
FIG. 4
FIG. 5
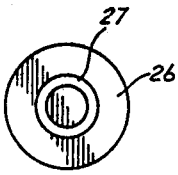
FIG. 6
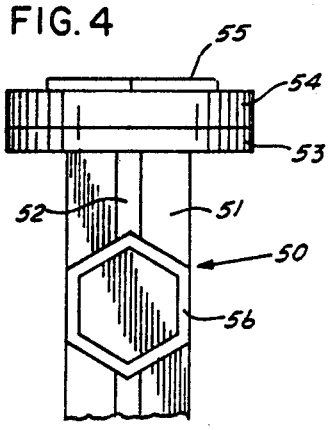
FIG. 7
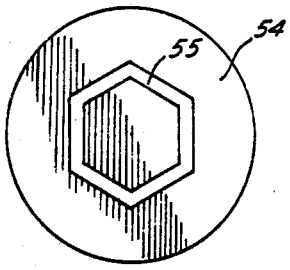
FIG. 8

MULTIPLE HEAD RUBBER STAMP

This invention relates to a multiple head rubber stamp with a rubber stamp mounted on the end of the crossed arms of a stamp frame, and including multiple indicating means adjacent each rubber stamp for the touch determination of the desired rubber stamp.

BACKGROUND OF THE INVENTION

In many businesses, recording various data on a map, chart, graph or the like requires repetative actions of the physical activity of adding one or more signs, symbols or indicia to the record being kept. The recording of sales efforts at various location on a map of sales territories may require marking the locations with a number of different indicia. In one form, the map may have color headed pins pressed in various areas to show different activities, or in other forms, a particular mark may be made on the map indicating the same type of information as the colored pins. A geological map for showing the location of oil, gas, oil and gas and dry wells, for example, is usually marked with any of four or more symbols indicating the well type. Chemists may use a number of symbols in the many types of writings required of them. Other business repetitively use other types of symbols for many purposes. In many cases, the person marking the map, chart or graph looks up the information, finds the location for marking, and uses the finger of one hand to point to the location. The user's free hand is used for a pencil, pen, stamp, pin or other symbol or marker for adding it to the document. In the marking of a graph, map, chart, etc., where several stamps are used, the information is first read and dexterity to a high degree is necessary to find location on the document and then find the correct symbol to be affixed to the correct location on the document.

For the oil and gas business, maps of small portions of states are used to provide a showing of land sections (1 mile by 1 mile) in usually $\frac{1}{4}$ to $\frac{3}{8}$ inch squares. The drilling activity in any section is recorded by one or more of four symbols which indicate the character of the well, including oil wells, oil-gas wells, gas wells and dry holes. Since the section representation is quite small the symbols must be necessarily small to fit on the map. Such symbols have hereto been posted by hand, making it a laborious and time consuming project. Usually, drilling reports are available weekly, and therefore the manual posting is normally preformed weekly.

THE PRESENT INVENTION

The rubber stamp of the invention provides a frame having 3,4,5,6, or more radially extending arms, of different lengths, a rubber stamp secured to the end of each arm (with a different symbol) and indicating means secured to or formed on each arm adjacent the end, for a tactile sensing of the symbol on the arm. In a preferred form, the frame is made of a molded, high strength synthetic plastic. In one form, the frame has four arms, each of different length, and raised indicia, of the rubber stamp symbol, is formed each arm end. The length of the arm, and the indicia provide tactual sensing by the users finger tips, without the requirement of visual selection of the symbol desired.

OBJECTS AND ADVANTAGES OF THE INVENTION

Included among the objects and advantages of the invention is to provide a multiple rubber stamp device, with stamp mounted on the arm having tactile indicia.

Another object of the invention is to provide a frame having a plurality of radial arms of different lengths, with a rubber stamp on the end of each arm.

Still another object of the invention is provide a multiple extending arm device providing two tactile indicia, of the attached rubber stamp, for each arm.

Yet another object of the invention is to provide a multiple armed frame in which the arms extending radially from a central position, and each arm includes an end platform for securing a rubber stamp thereon.

An additional object of the invention is to provide a multiple armed rubber stamp formed of a frame having radial arms generally uniforming spaced around a central point, and having a raised symbol on each arm of the equivalent symbol of the rubber stamp.

These and other objects of the invention may be ascertained by reference to the following description and appended illustrations, in which:

GENERAL DESCRIPTION OF THE DRAWINGS

FIG. 1 is a side elevational view of a four armed rubber stamp device according to the invention.

FIG. 2 is an end elevation of one rubber stamp taken from line 2—2 of FIG. 1.

FIG. 3 is an enlarged detailed portion of the end of one arm of FIG. 2.

FIG. 4 is a cross-sectional view of the arm of FIG. 2 taken along section line 4—4 of FIG. 1.

FIG. 5 is a cross sectional view of an arm taken along 5—5 of FIG. 5.

FIG. 6 is an end elevation of an arm, using an alternate symbol.

FIG. 7 is an enlarged detail of a modified arm end of a stamp using the symbol for benzene ring.

FIG. 8 is an end elevational view of the rubber stamp and of the device of FIG. 7.

SPECIFIC DESCRIPTION OF THE DRAWINGS

In one preferred form of the invention as shown in FIG. 1, a cross arm frame, shown generally by numeral 10, includes extending arms 12, 14, 16, and 18, each of a different length. Each arm includes a squared end for seating a rubber stamp and securing the same thereto. For an example, the arm 16 is formed as a cross of a molded plastic for strength, and the other arms are similarly molded. Thus arm 16, FIG. 4, includes a four arm-right angle cross having arms 16*a*, 16*b*, 16*c* and 16*d*. The end of the arm has a circular platform 17 at a right angle to the axis of the arm. The platform has a rubber stamp 20 secured thereto as by an adhesive or the like, and an indicia 21, is formed on the rubber backing, in this case an eight armed star with a hole in the middle. An indicia 24 is molded on the arm adjacent the end, with an equivalent symbol as the rubber stamp symbol, and for this arm—an eight armed star.

Each arm is formed as a cross and each has a stamp holding platform. Thus, arm 12 includes platform 13 with a rubber stamp back 26 on which is formed a rubber stamp 27, in this case concentric circles. Tactile indicia 28 is formed on the arm 12 adjacent the outer end. The arm 14 includes a platform 15 for a rubber stamp backing 30 having a symbol 31, a solid circle, and tactile indicia 32 is formed on the arm adjacent the end. In a similar manner, arm 18 includes a platform 19 for a stamp backing 35 having a rubber stamp symbol 36, in this case a four arm cross. A tactile indicia 37 is formed on the arm 18 indicating the cross symbol of the stamp.

The cross frame is provided with fillets 38 between the arms, at the center intersections of the arms. This provides strengthening for the extending arms. The cross-arm construction of the arms and the fillets permits the use of thin sections of plastic. The indicia on each arm is generally in the same plane as the arm (or it may be called a rib) for each extending frame arm. The indicia is formed on both sides of the frame, considering the two major faces as the sides.

For other symbols, the frame is provided with a platform of a size to accommodate the backing of the rubber stamp symbol. As shown in FIGS. 7 and 8 an arm, shown generally by numeral 50, formed of crossing ribs 51 and 52. A platform 53 supports a secured backing 54 of a rubber stamp with a symbol 55 formed as a benzene ring. The stamp frame may have 4 or more arms and different size of symbols may be used on the rubber stamp. This permits the use of the device for different types of writings requiring different sizes of symbols. Also, different symbols may be used as desired. For the chemical industries of art, each writer may have specialized symbols, and such symbols may be secured to the end of the different lengths of arms. For the benzene ring of FIG. 7, an arm indicia 56 provides tactile sensing of the symbol of the rubber stamp.

The stamp frame is provided with different lengths of arms, which is a tactile sensory device for aiding in finding the correct arm of the frame, used along with the symbol formed on the side of the frame. Thus, a worker with a little practice may be able to pick up the stamp frame, find the desired arm without looking at the arm. The stamp frame may be turned to correct position, and after dabbing an ink pad, the symbol may be placed on the document being posted. As the number of symbols desired may range from 3 to 6 or more, the frame may be formed with the desired number of arms. The practical limit of the number arms is generally determined by the overall size of frame and symbols. For a frame having two crossed arms of about 3 ¼ inches in length, four arms may be preferred (the length of the individual extending arms is determined by the location of the center). With larger frames, of 4, 5, 6 inches or more. The number of arms may be increased. It is desirable to maintain spacing between the arms for easy tactile sensing by the user's fingers. A stamp frame for posting a drilling map for the petroleum industry includes crossed extending arms about 3 ¼ inches long. One arm is 1 inch long and its opposite arm is about 2 inches long from platform to center. The rubber stamps are about ⅛ inches thick. The other crossed arm includes one that is about 1 ¼ inches long with its oppposite side about 1 ¾ inches long, with the rubber stamps being about ⅛ inches thick.

While the invention has been described with reference to specific embodiments, the concept of the invention is not limited thereto but as defined in the following claims.

What is claimed is:

1. A multiple rubber stamp device, comprising (a) stamp frame means having a plurality of arms extending outwardly from a central joining position, (b) a rubber stamp platform secured to each end of each said extending arm, providing a surface for attachment of a rubber stamp, (c) rubber stamp means secured on each said rubber stamp platform, and each rubber stamp means having a symbol formed thereon, and (d) tactile sensing means comprising indicia formed on each of said extending arms adjacent the rubber stamp means secured to the end thereof, said indicia corresponding to the symbol formed on said rubber stamp means for tactile sensing by a users' fingers and said extending arms being different lengths from said central joining position to the end of each arm for tactile sensing by a user's fingers.

2. A multiple rubber stamp device according to claim 1 wherein said stamp frame means includes four arms extending from said central joining position.

3. A multiple rubber stamp device according to claim 1 wherein the plane of each said rubber stamp platform is at a right angle to the axis of each said extending arm.

4. A multiple rubber stamp device according to claim 1 wherein said stamp frame means is molded of a synthetic plastic.

5. A multiple rubber stamp device according to claim 4 wherein each said arm is formed of crossed ribs.

6. A multiple rubber stamp device according to claim 5 wherein said indicia is formed on opposite sides of each rib and each is in the plane of said rib.

* * * * *